US009619991B1

(12) United States Patent
Roohani

(10) Patent No.: US 9,619,991 B1
(45) Date of Patent: Apr. 11, 2017

(54) METHOD AND APPARATUS FOR USING WATER TO DISABLE AN ALARM CLOCK

(71) Applicant: Bashir Roohani, Temple City, CA (US)

(72) Inventor: Bashir Roohani, Temple City, CA (US)

( * ) Notice: Subject to any disclaimer, the term of this patent is extended or adjusted under 35 U.S.C. 154(b) by 0 days.

(21) Appl. No.: 15/213,670

(22) Filed: Jul. 19, 2016

Related U.S. Application Data

(63) Continuation-in-part of application No. 15/014,001, filed on Jul. 19, 2016.

(51) Int. Cl.

| | |
|---|---|
| ***G08B 21/00*** | (2006.01) |
| ***G08B 25/00*** | (2006.01) |
| ***G08B 21/24*** | (2006.01) |
| ***A47G 19/22*** | (2006.01) |

(52) U.S. Cl.
CPC ..... *G08B 25/001* (2013.01); *A47G 19/2227* (2013.01); *G08B 21/24* (2013.01); *A47G 2019/2244* (2013.01); *A47G 2200/183* (2013.01)

(58) Field of Classification Search
CPC ..... G08B 21/18; G08B 21/24; G08B 21/00; H04W 4/12; H04W 4/18; H04L 51/38; A47G 19/2227; A47G 19/027; A47G 19/2288
USPC ..... 340/384.1, 384.7, 450, 457, 539.1, 340/539.11, 572.3, 573.1, 540, 618; 235/383, 385; 705/22, 23; 219/387, 432, 219/435, 441; 62/3.1, 3.3
See application file for complete search history.

(56) References Cited

U.S. PATENT DOCUMENTS

| | | | | |
|---|---|---|---|---|
| 9,035,222 | B2 * | 5/2015 | Alexander | 165/58 |
| 2013/0200064 | A1 * | 8/2013 | Alexander | A47G 19/2288 219/441 |
| 2015/0334079 | A1 * | 11/2015 | Laidlaw | H04L 51/38 340/539.11 |

* cited by examiner

*Primary Examiner* — Hung T Nguyen
(74) *Attorney, Agent, or Firm* — Matthew M. Googe; Robinson IP Law, PLLC

(57) ABSTRACT

An alarm clock device is provided that includes a deactivation apparatus for attaching to a fluid container that includes a housing, a clip formed on an exterior surface of the housing, the clip shaped to fit over an edge of the fluid container such that the housing rests adjacent to a surface of the fluid container, and a orientation sensing component disposed within the housing, the orientation sensing component configured to detect an angular orientation and movement of the deactivation apparatus. The alarm device includes an alarm apparatus for emitting an alert at a desired time, the alarm apparatus in communication with the deactivation apparatus. An alert emitted by the alarm apparatus is silenced when the orientation sensing component of the deactivation apparatus detects a change in an angular orientation of the deactivation apparatus corresponding to a user lifting and drinking from the fluid container.

10 Claims, 8 Drawing Sheets

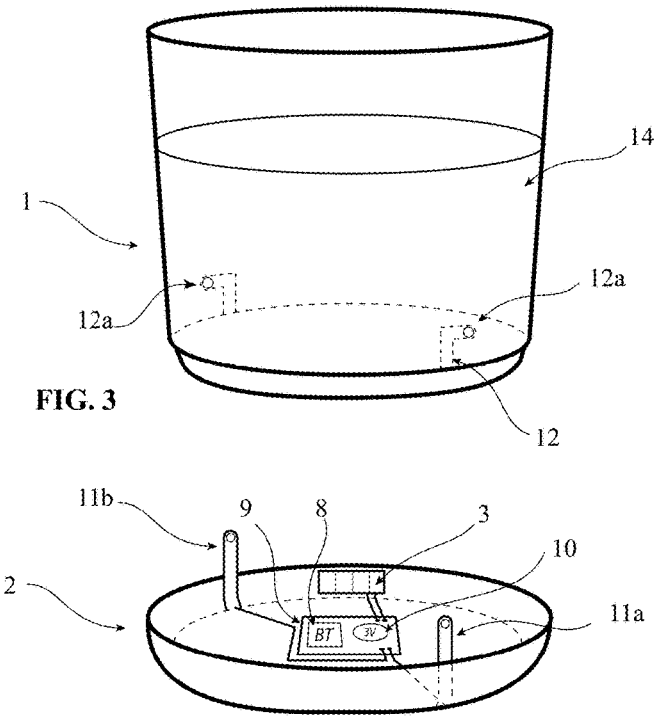
FIG. 3
FIG. 4
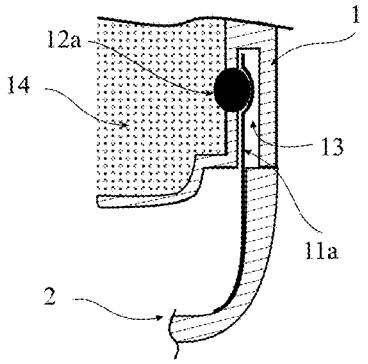
FIG. 5
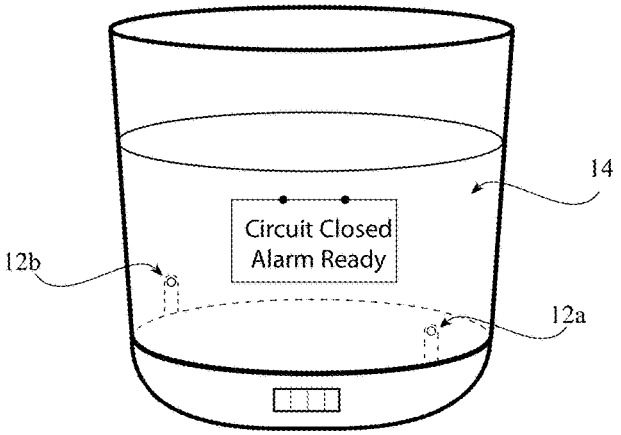

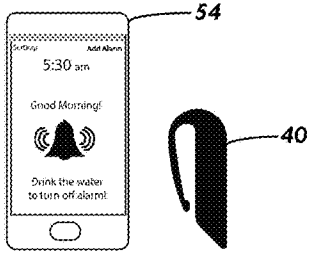
FIG. 18
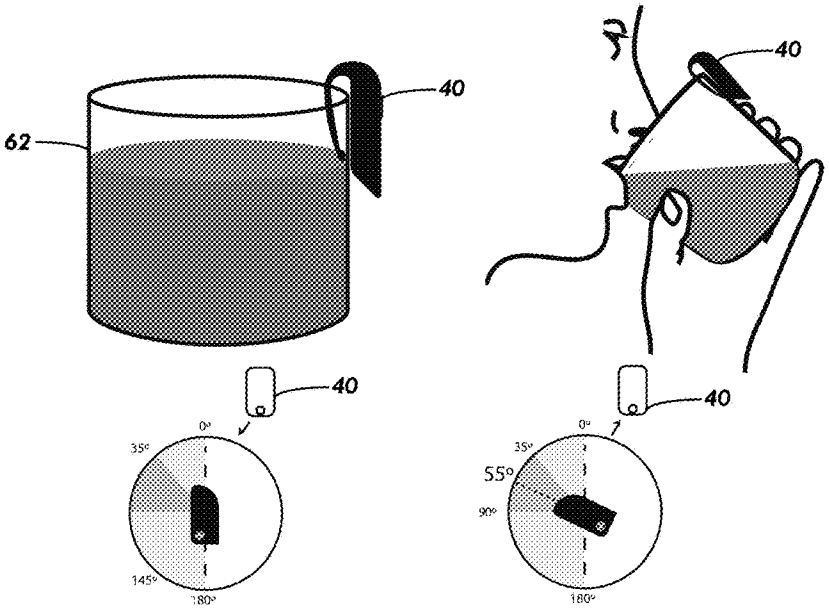
FIG. 19
FIG. 20
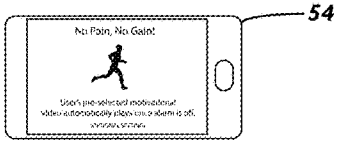
FIG. 21

METHOD AND APPARATUS FOR USING WATER TO DISABLE AN ALARM CLOCK

CROSS-REFERENCE TO RELATED APPLICATION

This application claims priority to and is a continuation-in-part of U.S. patent application Ser. No. 15/014,001 to Bashir Roohani for a Method and Apparatus for Using Water Level to Disable an Alarm Clock, which was filed on Feb. 2, 2016, the contents of which are incorporated herein by reference in its entirety.

FIELD

This disclosure relates to the field of alarm clocks. More particularly, this disclosure relates to alarm requiring a user to get out of bed and perform an action to deactivate the alarm.

BACKGROUND

People depend on the alarm clock to be present at work on time, attend school, or have enough time to exercise in the morning before starting their day. The problem with the existing alarm clock systems is that often they do not wake up the user and leave her feeling sleep. The user may open her eyes and turn off the alarm, but she still wants to get a few extra minutes of sleep. This going back and forth causes fragmented sleep, which is worse than no sleep, and it is particularly made easy by the snooze button. The snooze button silences the alarm temporarily giving the user typically nine extra minutes to sleep.

Those with a difficult time waking up in the morning, have a tendency to overuse the snooze button and as a result get out of bed much later than they originally intended. This cycle of repeated use of the snooze button and alternating awake states every nine minutes has negative health consequences on both the brain and the body. At the end, the user feels they have lost precious time before she even begins her day.

There have been many attempts to make waking up in the morning easy but they don't work for most users. Most consumers attempt to put the alarm clock out of reach to force them out of bed; however, they still feel sleepy so they return to bed only to get extra sleep again. Others adjust the clock time forward in an attempt to trick themselves in the morning when waking up. This method fails because most would remember how many minutes they offset the time and thus go back to sleep.

Other manufacturers have even designed alarm clocks that jump off the nightstand and roll around on their wheels until the user gets out of bed and catches the runaway alarm. This method also fails because the user is still sleepy and can easily go back to bed for an extra few minutes of sleep. Sometimes the jumping alarm clock does not even get very far out of reach.

SUMMARY

The subject invention is described in two embodiments. Both methods require the user to drink the water out of the container when the alarm wakes her up. Once the presence of water is no longer detected in the container, the alarm is disabled.

There are several advantages to this method of disabling the alarm clock. As a result of drinking the water, not only the sound of the alarm is disabled, but also the user is no longer feeling sleepy and is fully awake. As water is essential to life, this method also promotes the healthy habit drinking water; moreover, if the user wakes up after eight hours of sleep, she is usually dehydrated since she has gone that entire time without drinking water.

In one or more embodiments, the invention comprises a water container or a cup equipped with Bluetooth radio chip, a power source, and two probes to detect the presence of water. It is accompanied by a mobile application, which the user will install. The water holding container will be paired via Bluetooth or any other suitable wireless communication network with the mobile device and the user can set the alarm clock but only when the presence of water is detected inside the container. When the alarm sounds the user is required to drink or dispose of the water to stop the alarm.

In the another embodiment, the water holding container is placed on a docking station equipped with a LCD display and interface to display time and for user to set current time, alarm clock, volume, etc. Unlike the first embodiment, the container or cup does not require a Bluetooth communication component or a power source, only the two probes which will detect the presence of water. All electric components may be placed in the docking station with connectors, which will align and connect with the probes on the water container once it is placed on the dock.

Other embodiments of the invention may utilize an accelerometer attached to the cup to detect the rotational changes as the user is drinking the water out of the cup. These changes will trigger the alarm to shut off.

In one aspect, an alarm clock device is provided including: a deactivation apparatus for attaching to a fluid container, the deactivation apparatus including a housing, a clip formed on an exterior surface of the housing, the clip shaped to fit over an edge of the fluid container such that the housing rests adjacent to a surface of the fluid container, an orientation sensing component disposed within the housing, the orientation sensing component configured to detect an angular orientation and movement of the deactivation apparatus; an alarm apparatus for emitting an alert at a desired time, the alarm apparatus in communication with the deactivation apparatus; wherein an alert emitted by the alarm apparatus is silenced when the orientation sensing component of the deactivation apparatus detects a change in an angular orientation of the deactivation apparatus corresponding to a user lifting and drinking from the fluid container.

In one embodiment, the orientation sensing component is selected from the group consisting of an accelerometer and a gyroscope.

In another embodiment, the alert emitted by the alarm apparatus is silenced when the orientation sensing component of the deactivation apparatus detects that the fluid container is tiled at an angle of from about 35° to about 90° relative to a vertical axis.

In yet another embodiment, the deactivation apparatus further includes a light emitting component projecting from the housing of the deactivation apparatus.

In one embodiment, when the alarm apparatus emits an alert the light emitting component projects a first color, and wherein when the deactivation apparatus detects a change in angular orientation detects in change in angular orientation of the deactivation apparatus corresponding to a user lifting and drinking the fluid container the light emitting component projects a second color.

In another embodiment, the alarm apparatus is a smart phone. In yet another embodiment, the smart phone is in wireless communication with the orientation sensing component of the deactivation apparatus.

In one embodiment, when the alert emitted by the alarm apparatus is silenced in response to a user lifting and drinking from the fluid container, motivating media is displayed on a display of the smart phone.

In a second aspect, an alarm clock device is provided including: a deactivation apparatus for attaching to a fluid container, the deactivation apparatus including a housing, a clip formed on an exterior surface of the housing, the clip shaped to fit over an edge of the fluid container such that the housing rests adjacent to a surface of the fluid container, an orientation sensing component disposed within the housing, the orientation sensing component selected from the group consisting of a gyroscope and an accelerometer and configured to detect an angular orientation and movement of the deactivation apparatus; a smart phone including an alarm for emitting an alert at a desired time, the smart phone in communication with the deactivation apparatus; wherein an alert emitted by the alarm apparatus is silenced when the orientation sensing component of the deactivation apparatus detects a change in an angular orientation of the deactivation apparatus corresponding to a user lifting and tilting the fluid container to an angle of from about 35° to about 90° relative to a vertical axis.

In a third aspect, a method of activating and deactivating an alarm is provided, the method: providing a deactivation apparatus attached to a fluid container, the deactivation apparatus including a sensing component configured to detect a presence of fluid within the fluid container; providing an alarm apparatus in communication with the deactivation apparatus, the alarm apparatus configured to store and generate one or more alarms at a desired time; generating an alarm with the alarm apparatus at one or more of the desired times; detecting a change in an amount of fluid in the fluid container with the deactivation apparatus; and silencing the alarm generated with the alarm apparatus when the deactivation apparatus detects a change in the angular orientation of the fluid container corresponding to a user lifting and drinking from the fluid container.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

FIG. 3 illustrates an exploded view of the water holding device of FIG. 1 showing the water container component and the electric component housing;

FIG. 4 is a breakout cross-sectional illustration showing the coupling of the water holding container and the electric component housing;

FIG. 5 illustrates the closed circuit when water is present in the container;

FIGS. 18-21 illustrate embodiments of the alarm including a deactivation apparatus according to one embodiment of the present disclosure.

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

One or more embodiments of the present invention will now be described with references to FIGS. 1-11.

Figure 1:
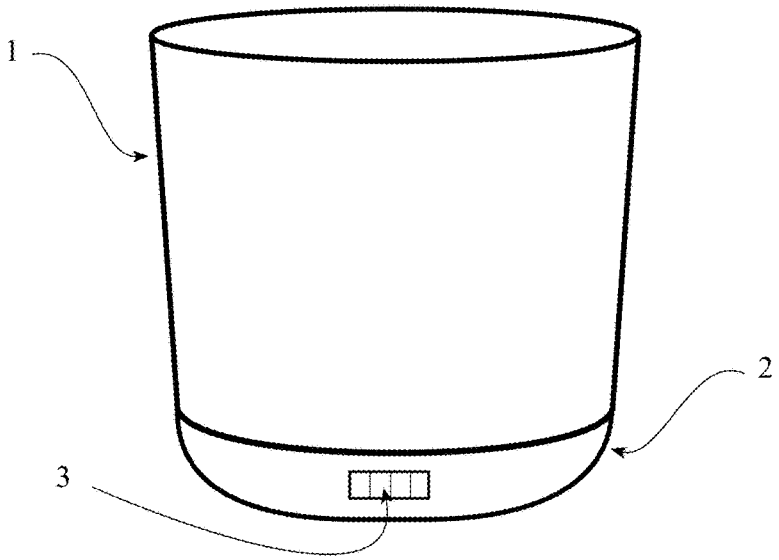
FIG. 1 illustrates a water holding apparatus in accordance with one or more embodiments of the invention.

FIG. 1 illustrates the water holding apparatus in accordance with the first embodiment of the invention. There are three visible parts: water or fluid holding container 1, electric components enclosure 2, and solar cell panel 3 to charge the internal 3V rechargeable coin battery 10 illustrated in FIG. 3.

Figure 2:
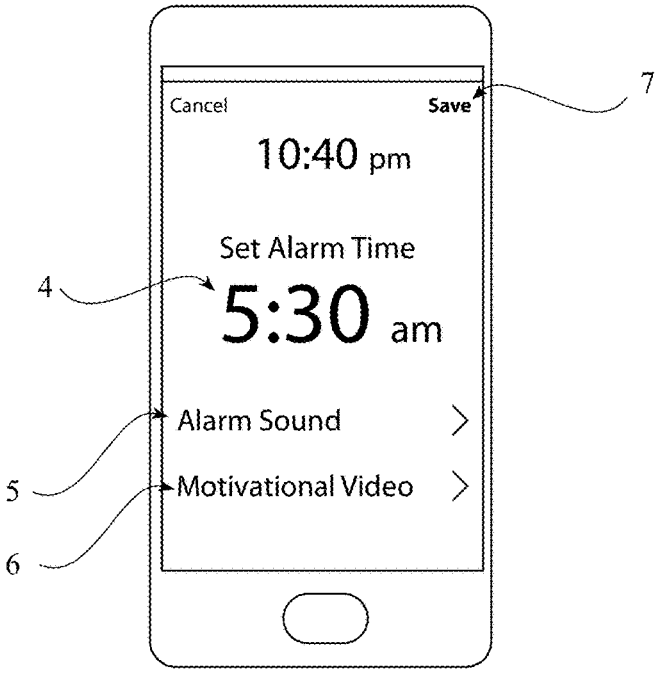
FIG. 2 illustrates a mobile user interface for a user to set the alarm clock in accordance with one or more embodiments of the invention.

FIG. 2 illustrates the mobile user interface for user to set the alarm clock. Once the desired time to wake up 4 she has the option of changing the type of sound the alarm will make 5 and a motivational video 6 as a follow up to the alarm which will motivate the user to stay awake and pursue the mission of the day. At this point, the user will tap on the Save button 7. At this point, the mobile application checks to see if there is water present in the container or not.

FIG. 3 illustrates the exploded view of the embodiment of the invention. When the phone communicates with the container, it will do so with the Bluetooth chip 8 placed on the electric board 9 inside the electric board housing 2. The device is powered by a 3V rechargeable coin battery 10 which is charged by a solar panel located outside container 3. When the Bluetooth chip 8 receives the request from the mobile device FIG. 2, the electric board 9 will send a small current to the probes 12*a* and 12*b* via connectors 11*a* and 11*b*.

FIG. 4 illustrates the cross section where the two parts join to connect the electric probes 12*a* and 12*b*. The connectors from the electric component housing 2 are connected using the twist and lock method through a cavity 13 inside the walls of the water container 1. Once the small current is passed through the probes 12*a* and 12*b*, the presence of water will be determined if the conductive properties of water 14 close the circuit between the two probes 12*a* and 12*b*.

FIG. 5 illustrates the closed circuit when water is present in the container. If circuit then the Save button 7 in FIG. 2 will complete the alarm setting process.

Figure 6:
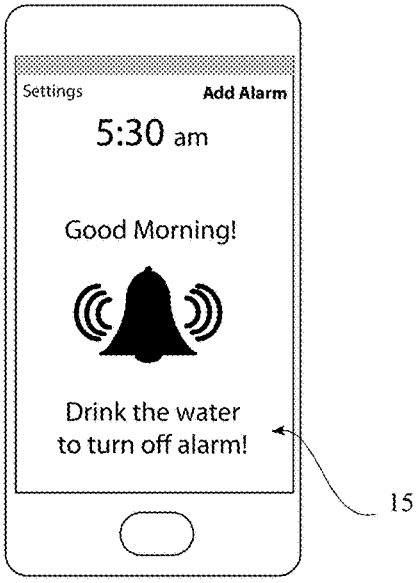
FIG. 6 illustrates the user interface when the alarm clock is active sounds to wake up the user.

FIG. 6 illustrates the user interface when the alarm clock is active sounds to wake up the user. User is instructed 15 to drink the water 14 from the container 1 as it is the only way to turn off the sound of the alarm. Alarm continues to ring until the actions in FIG. 7 are complete.

Figure 7:
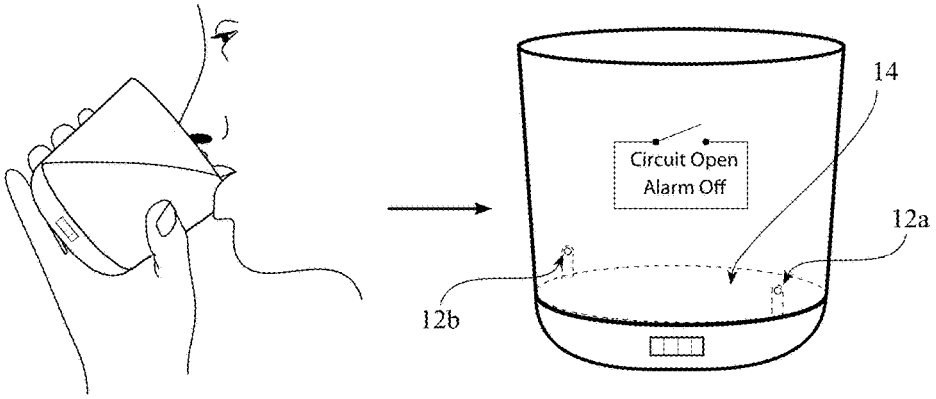
FIG. 7 illustrates the user drinking the water and the probes disconnected by lack of water.

FIG. 7 illustrates the user drinking the water and the probes disconnected by lack of water. As the user drinks the water, the level of the water 14 falls under the level of the probes 12*a* and 12*b* which as a result will not be able to close the small electric circuit, thus rendering the alarm silent.

Figure 8:
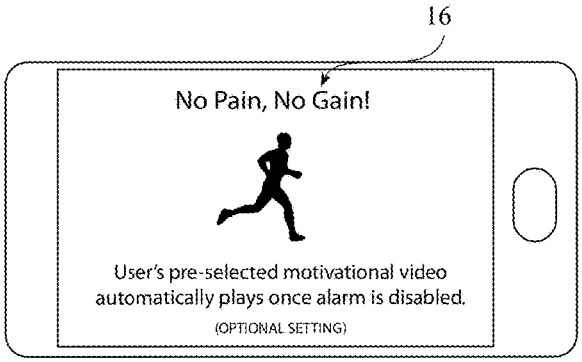
FIG. 8 illustrates a motivational video playing to keep the user up and inspired to start the day.

FIG. 8 illustrates a motivation video playing to keep the user up and inspired to start the day. Users are given an optional follow up method to keep the user awake. The user's motivational choice of video will begin playing 16 immediately after the alarm is disabled.

Figure 9:
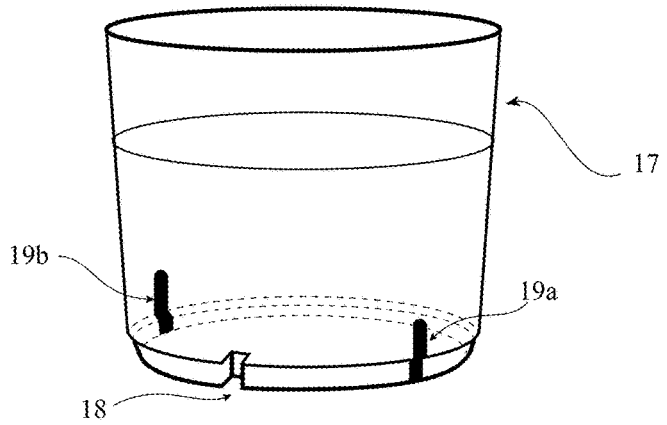
FIG. 9 illustrates another embodiment water holding container.

FIG. 9 illustrates the water containing apparatus is the second embodiment of the invention. In this second embodiment the water container 17 has two conductive probes 19*a* and 19*b* similar to the first embodiment. It also has a groove 18 which will align with the not mark 22 on FIG. 10 to assure proper alignment with the connectors 20*a* and 20*b* in FIG. 10 by only allowing it to fit one way into the docking station FIG. 10.

Figure 10:
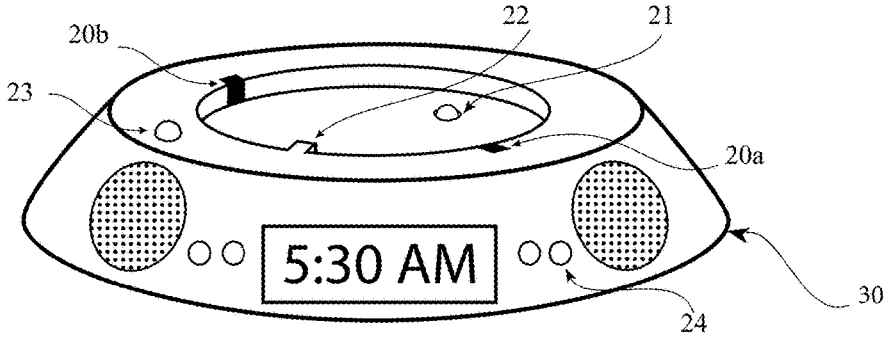
FIG. 10 illustrates the docking station, which houses the alarm system and electric components for the water holding container embodiment of FIG. 9.

FIG. 10 illustrates the docking station that houses the alarm system and electric components in accordance with another embodiment of the present invention. Once the user fills the container 17 with water, the container is then placed on the docking station 30 that will depress a switch 21. The purpose of this switch is to allow for distinction of whether the open circuit is as a result of no water present in the container (when button is depressed and an empty cup is placed on top) or simply because no cup has been placed on the dock.

Figure 11:
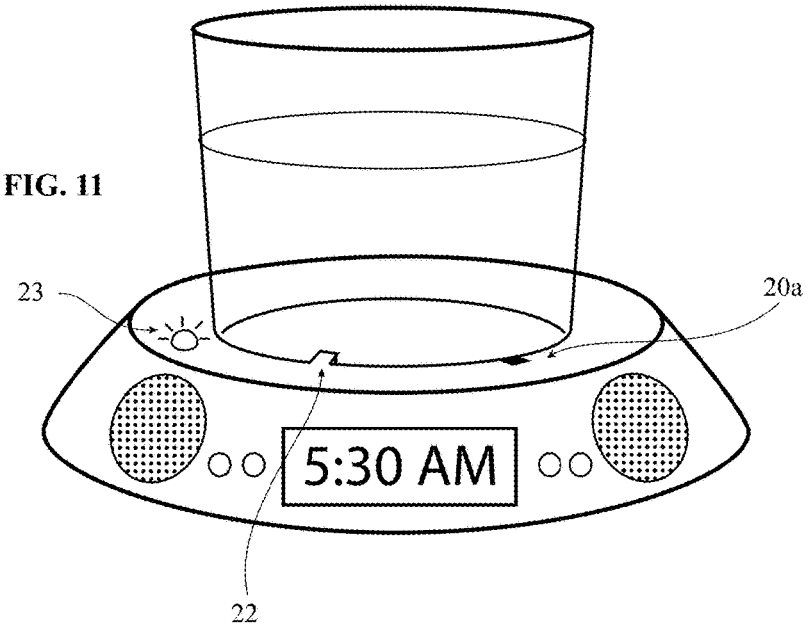
FIG. 11 illustrates the water holding apparatus in accordance with the embodiment of FIG. 9.
Figure 12:
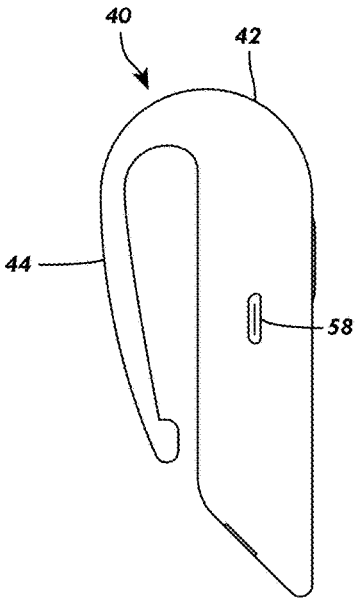
FIGS. 12-17 illustrate a deactivation apparatus according to one embodiment of the present disclosure.
Figure 13:
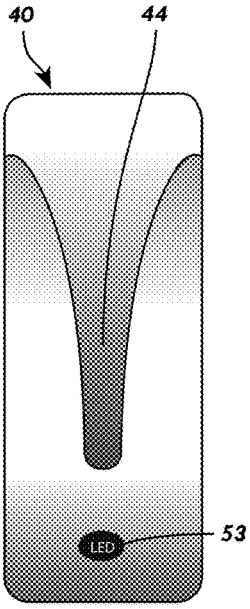
Figure 14:
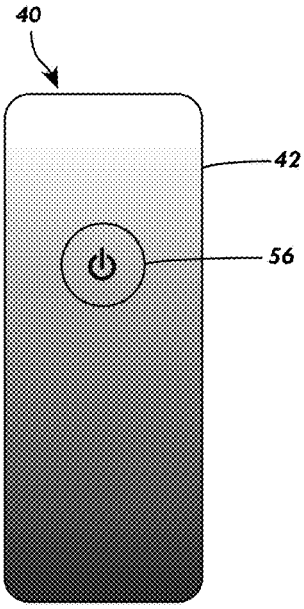
Figure 15:
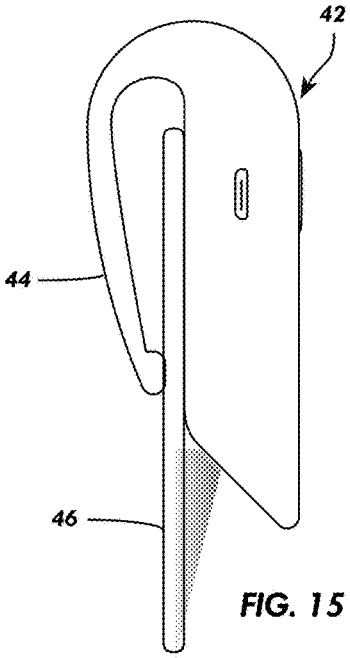
Figure 16:
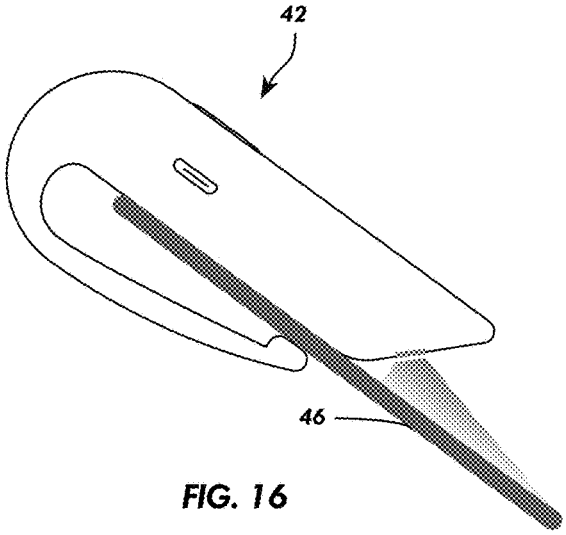

FIG. 11 illustrates the water holding container 17 in place on the docking station. When the container 17 is placed on top of the docking station 30, the connectors 20*a* and 20*b* are connected to the probes 19*a* and 19*b*, and thus ready to check for presence of water.

Referring now to FIGS. 12-17, one embodiment of the alarm clock device includes a deactivation apparatus 40 for detecting an orientation of a fluid container and silencing an alarm based on movement and change in orientation of the fluid container. The deactivation apparatus 40 includes a housing 42 and a clip 44 formed on the housing for securing the deactivation apparatus to a fluid container. The clip 44 is shaped to fit over an edge of a wall 46 of a fluid container to attach the deactivation apparatus 40 to the fluid container.

Figure 17:
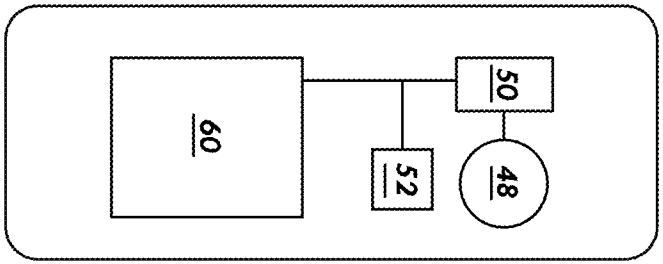

One or more electronic components are disposed within the housing 42 of the deactivation apparatus, as shown in FIG. 17. The deactivation apparatus 40 includes an orientation sensing component 48 for detecting movement or an angular orientation of the deactivation apparatus 40. The orientation sensing component 48 may be one of a gyroscope or accelerometer that is configured to detect movement or orientation of the deactivation apparatus 40. The deactivation apparatus 40 also includes a controller 50 in communication with the orientation sensing component 48. A communications module 52 may also be in communication with the controller 50 within the deactivation apparatus for communicating with an external device, such as wirelessly over a Bluetooth® or other wireless protocol. A light emitting component 53 may also be included on the deactivation apparatus 40 for projecting a light from the deactivation apparatus 40. One or more inputs may be included on the deactivation apparatus, such as a power button 56 or a wired input 58 such as a USB. The deactivation apparatus 40 may also include an LED on the housing 42 that indicates a status of the deactivation apparatus. A power source 60 may also be provided, the power source 60 in communication with the controller and other components of the deactivation apparatus 40.

As shown in FIG. 18, an alarm apparatus 54 is also provided for emitting an alert or otherwise creating an alarm at a desired time. The alarm apparatus 54 is in communication with the deactivation apparatus 40. The alarm apparatus 54 is preferably a smart phone or other personal device including a display. A user interface displayed on the display of the alarm apparatus 54 allows a user to enter data related to a desired alarm time.

Referring to FIGS. 18-21, the alarm apparatus 54 generates an alarm including one or more audio or visual alerts emitted from the alarm apparatus 54 or other nearby devices. When an alarm is generated with the alarm apparatus 54, an angle of a fluid container 62 is detected by the deactivation apparatus 40. If an angle of the fluid container 62 is unchanged, the alarm will continue to sound. If an angle or movement of the fluid container 62 is detected to correspond to a user drinking a fluid from the fluid container 62 by the orientation sensing component 48 of the deactivation apparatus 42, the alarm is silenced or deactivated. Specifically, if the orientation sensing component 48 detects that the fluid container 62 has been tilted to an angle of between 35° and 90°, the alarm apparatus 54 silences the alarm and displays a motivational message (FIG. 22) to a user.

In one embodiment, light emitting component 53 emits a first color when an alarm is activated by the alarm apparatus 54. When the deactivation component 40 detects that the fluid container has been lifted by the user and tilted, the color emitted from the light emitting component 53 may be changed to a second color to provide visual confirmation that the container has been tilted to an appropriate angle.

Figure 22:
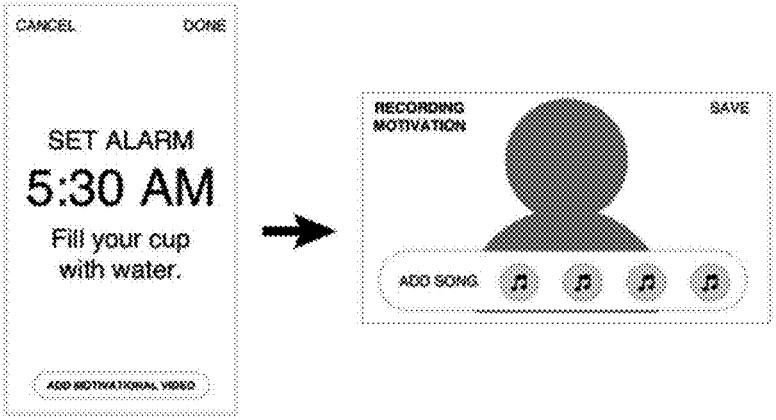
FIGS. 22 and 23 illustrate a user interface for creating customized motivational messages for an alarm according to one embodiment of the present disclosure.
Figure 23:
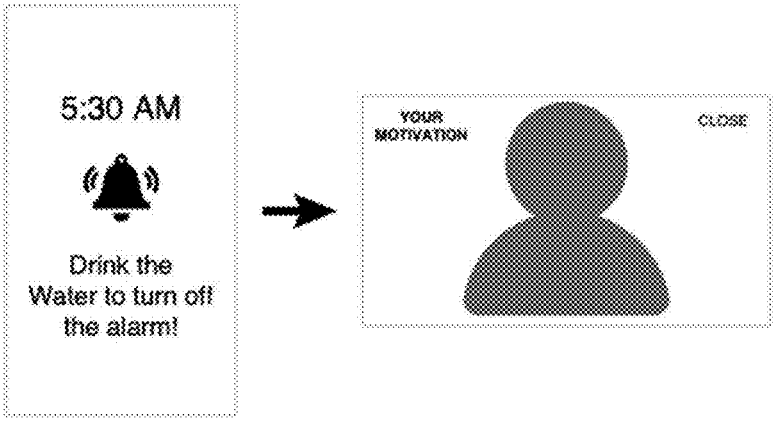

Referring to FIGS. 22 and 23, in one embodiment a user may create custom motivational messages on the alarm apparatus to be displayed when the user successfully deactivates the alarm by drinking from the fluid container. When a user sets an alarm on the alarm apparatus, information on the display of the alarm apparatus may include a time of the alarm, a reminder for the user to fill the fluid container with water, and an input to allow the user to create a custom media motivational message stored on the alarm apparatus. When the alarm is activated, a message is displayed on the display of the alarm apparatus alerting a user to deactivate the alarm by taking a drink from the fluid container. After successfully deactivating the alarm by drinking from the fluid container, one or more custom motivational messages are displayed on the alarm apparatus to the user.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An alarm clock device comprising:

a deactivation apparatus for attaching to a fluid container, the deactivation apparatus including a housing, a clip formed on an exterior surface of the housing, the clip shaped to fit over an edge of the fluid container such that the housing rests adjacent to a surface of the fluid container, an orientation sensing component disposed within the housing, the orientation sensing component configured to detect an angular orientation and movement of the deactivation apparatus;

an alarm apparatus for emitting an alert at a desired time, the alarm apparatus in communication with the deactivation apparatus;

wherein the alert emitted by the alarm apparatus is silenced when the orientation sensing component of the deactivation apparatus detects a change in an angular orientation of the deactivation apparatus corresponding to a user lifting and drinking from the fluid container.

2. The alarm clock device of claim 1, wherein the orientation sensing component is selected from the group consisting of an accelerometer and a gyroscope.

3. The alarm clock device of claim 1, wherein the alert emitted by the alarm apparatus is silenced when the orientation sensing component of the deactivation apparatus detects that the fluid container is tiled at an angle of from about 35° to about 90° relative to a vertical axis.

4. The alarm clock device of claim 1, the deactivation apparatus further comprising a light emitting component projecting from the housing of the deactivation apparatus.

5. The alarm clock device of claim 3, wherein when the alarm apparatus emits the alert the light emitting component projects a first color, and wherein when the deactivation apparatus detects a change in angular orientation detects in change in angular orientation of the deactivation apparatus corresponding to the user lifting and drinking the fluid container, the light emitting component projects a second color.

6. The alarm clock device of claim 1, wherein the alarm apparatus comprises a smart phone.

7. The alarm clock device of claim 6, wherein the smart phone is in wireless communication with the orientation sensing component of the deactivation apparatus.

8. The alarm clock device of claim 6, wherein when the alert emitted by the alarm apparatus is silenced in response to a user lifting and drinking from the fluid container, motivating media is displayed on a display of the smart phone.

9. An alarm clock device comprising:

a deactivation apparatus for attaching to a fluid container, the deactivation apparatus including a housing, a clip formed on an exterior surface of the housing, the clip shaped to fit over an edge of the fluid container such that the housing rests adjacent to a surface of the fluid container, an orientation sensing component disposed within the housing, the orientation sensing component selected from the group consisting of a gyroscope and an accelerometer and configured to detect an angular orientation and movement of the deactivation apparatus;

a smart phone including an alarm for emitting an alert at a desired time, the smart phone in communication with the deactivation apparatus;

wherein the alert emitted by the alarm apparatus is silenced when the orientation sensing component of the deactivation apparatus detects a change in the angular orientation of the deactivation apparatus corresponding to a user lifting and tilting the fluid container to an angle of from about 35° to about 90° relative to a vertical axis.

10. A method of activating and deactivating an alarm, the method comprising:

providing a deactivation apparatus attached to a fluid container, the deactivation apparatus including a sensing component configured to detect a presence of fluid within the fluid container;

providing an alarm apparatus in communication with the deactivation apparatus, the alarm apparatus configured to store and generate one or more alarms at a desired time;

generating an alarm with the alarm apparatus at one or more of the desired times;

detecting a change in an amount of fluid in the fluid container with the deactivation apparatus;

providing an orientation sensing component configured to detect an angular orientation and movement of the deactivation apparatus;

silencing the alarm generated by the alarm apparatus when the deactivation apparatus detects a change in the angular orientation of the fluid container corresponding to a user lifting and drinking from the fluid container.

* * * * *